US008633856B2

(12) United States Patent
Rao

(10) Patent No.: US 8,633,856 B2
(45) Date of Patent: Jan. 21, 2014

(54) COMPACT SINGLE FEED DUAL-POLARIZED DUAL-FREQUENCY BAND MICROSTRIP ANTENNA ARRAY

(75) Inventor: Qinjiang Rao, Waterloo (CA)

(73) Assignee: BlackBerry Limited, Waterloo, CA (US)

( * ) Notice: Subject to any disclaimer, the term of this patent is extended or adjusted under 35 U.S.C. 154(b) by 971 days.

(21) Appl. No.: 12/497,478

(22) Filed: Jul. 2, 2009

(65) Prior Publication Data

US 2011/0001682 A1 Jan. 6, 2011

(51) Int. Cl.
*H01Q 1/38* (2006.01)
*H01Q 9/16* (2006.01)

(52) U.S. Cl.
USPC ..... 343/700 MS; 343/793

(58) Field of Classification Search
USPC ..... 343/700 MS
See application file for complete search history.

(56) References Cited

U.S. PATENT DOCUMENTS

| | | | | |
|---|---|---|---|---|
| 3,196,443 | A * | 7/1965 | Martin | 343/797 |
| 7,508,346 | B2 | 3/2009 | Rao et al. | |
| 2003/0132890 | A1 | 7/2003 | Rawnick et al. | |
| 2003/0146872 | A1 | 8/2003 | Kellerman | |
| 2005/0116862 | A1 * | 6/2005 | du Toit | 343/700 MS |
| 2008/0252529 | A1 * | 10/2008 | Rao et al. | 343/700 MS |

FOREIGN PATENT DOCUMENTS

| | | | |
|---|---|---|---|
| DE | 4313397 | A1 | 11/1994 |
| FR | 2860344 | A1 | 4/2005 |
| WO | WO 9837592 | A1 | 8/1998 |

OTHER PUBLICATIONS

Office Action for EP Patent Application No. 10168363.9 dated Jan. 17, 2012.
Adrian et al., "Dual aperture-coupled microstrip antenna for dual or circular polarization", Electronics Letters, vol. 23, No. 23, Nov. 1987, pp. 1226-1228.
Parker et al., "Dual-polarized microstrip ring antenna with good isolation", Electronics Letters, May 1998, vol. 34, No. 11, pp. 1043-1044.
Gao et al., "A Broad-Band, Dual-Polarized Microstrip Patch Antenna with Aperture Coupling", IEEE Transactions on Antennas and Propagation, vol. 51, No. 4, Apr. 2003, pp. 898-900.
"Microstrip Antenna Arrays on Multilayer LCP Substrates", NASA Tech Briefs, John H. Glenn Research Center, Cleveland Ohio, Jan. 2007, 1 page http://www.techbriefs.com/component/content/article/1098.
Pozar et al., "Microstrip antennas: The Analysis and Design of Microstrip Antennas and Arrays", May 1995, 448 pages, Wiley—IEEE Press http://www.ieeexplore.ieee.org/books/bkprintabstract.jsp?bkn=0780310780.
Uher et al., "Dual polarized C-band patch array with low cross-polarization", Conference Proceedings ANTEM, 1994, pp. 134-136.
European Search Report for Application No. EP 10168363 dated Oct. 29, 2010.

* cited by examiner

*Primary Examiner* — Jacob Y Choi
*Assistant Examiner* — Graham Smith
(74) *Attorney, Agent, or Firm* — Moffat & Co.

(57) ABSTRACT

A dual-polarized stacked patch antenna array that operates at two different frequencies. The stacked patch antenna array has a single planar patch antenna subarray disposed on opposite sides of a dielectric structure. The stacked patch antenna array includes a ground plane that is common to each planar patch array antenna. Each planar patch antenna subarray is fed from a single coaxial probe disposed through the center of the stacked antenna array structure. Each patch in the planar patch array antenna subarray is electrically connected by microstrip elements. Each patch and microstrip element is arranged along the X and Y axial directions. A single additional microstrip element is placed in a diagonal orientation in each subarray to connect two patches oppositely oriented within the stacked antenna array structure.

22 Claims, 7 Drawing Sheets

COMPACT SINGLE FEED DUAL-POLARIZED DUAL-FREQUENCY BAND MICROSTRIP ANTENNA ARRAY

CROSS-REFERENCE TO RELATED APPLICATIONS

This application is related to U.S. Pat. No. 7,508,346, dated Mar. 24, 2009 to Rao et al., and entitled Dual-Polarized, Microstrip Patch Antenna Array, And Associated Methodology for Radio Device, which is herein incorporated by reference for all purposes.

BACKGROUND

1. Technical Field

This disclosure relates to antenna diversity in wireless communication systems and more specifically to the design and implementation of a dual-polarization dual frequency planar antenna that resonates at two different operating frequencies.

2. Description of the Related Art

In the wireless communications industry, particularly the cellular industry, the capacity of communications systems may be enhanced or increased through frequency reuse and polarization diversity. Polarization diversity improves wireless performance by enabling a wireless device to transmit a signal at multiple polarizations. Polarization diversity may enhance frequency reuse and result in an improvement in the signal reception and transmission quality in wireless communication systems by decreasing the number of dropped or lost calls during a communication session or decreasing the number of dead spaces within a system.

BRIEF DESCRIPTION OF THE DRAWINGS

For a better understanding of this disclosure and the various embodiments described herein, reference is now made to the following brief description, taken in connection with the accompanying drawings and detailed description, which show at least one exemplary embodiment.

DETAILED DESCRIPTION

Figure 1A:
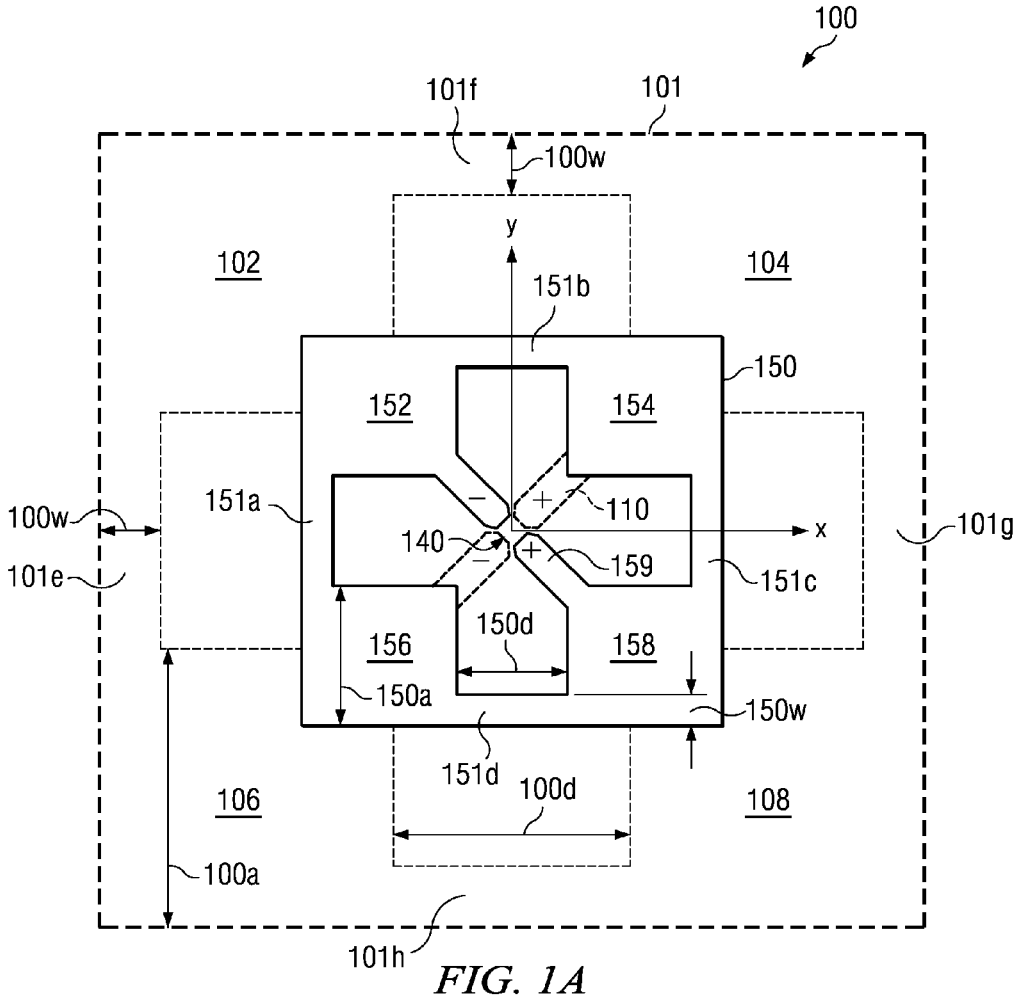
FIG. 1A illustrates a top view of a dual-polarization dual-band microstrip patch antenna array in accordance with one embodiment of the present disclosure.

It should be understood at the outset that although an illustrative implementation of one or more embodiments are provided below, the description is not to be considered as limiting the scope of the embodiments described herein. The disclosure may be implemented using any number of techniques, whether currently known or in existence. The disclosure should in no way be limited to the illustrative implementations, drawings, and techniques illustrated below, including the exemplary designs and implementations illustrated and described herein, that may be modified within the scope of the appended claims along with the full scope of equivalents. It would be appreciated that for simplicity and clarity of illustration, where considered appropriate, reference numerals may be repeated among the figures to indicate corresponding or analogous elements.

The present disclosure provides a single feed dual-polarized dual-frequency microstrip stacked patch antenna array structure. Each coplanar patch antenna array in the structure has a number of conductive patches. The patches may be rectangular or square in configuration. As used herein, "a number of" items refers to one or more items. For example, a number of patches means one or more patches.

The conductive patches are electrically connected to each other by interconnecting microstrip elements that are disposed along the edges of the patch antenna array. A single feedline extends upward and through a center of each stacked patch antenna array from a single coaxial probe. A pair of microstrip feed elements are inclined along an angle that is diagonal or approximately 45 degrees from the plane of the patch antenna array and connect two of the conductive patches disposed at opposing corners of the patch antenna array to the center feedline. As used herein, "approximately" means within a tolerance of ±5 degrees. The interconnecting microstrip elements radiate to produce in-phase current distributions on each polarization direction if the dimensions of the interconnecting microstrip elements and of the conducting patches are properly chosen. A first coplanar patch array in the antenna array structure is rotated at an angle of 90 degrees with respect to a second coplanar patch array to enable cross polarization.

Referring initially to FIG. 1A, the dual-polarization dual-band stacked patch antenna array 100 structure may comprise a number of subarrays. As used herein, "a number of" items refers to one or more items. In one embodiment, the dual-polarization dual-band microstrip patch antenna array structure 100 is comprised of two subarrays. Each subarray is a coplanar patch antenna array. A single feedpoint 140 that introduces current onto the microstrip antenna array structure 100 is disposed at a specific interior point of the stacked antenna array structure 100. The interior point may be one specific interior point located at the center of the antenna structure. The center may be located at a midpoint of orthogonal X and Y axes of the stacked antenna array 100.

One subarray of dual-polarization dual-band microstrip patch antenna array structure 100 is planar patch array antenna 150. In one embodiment, the perimeter of planar patch array antenna 150 is square. In another embodiment, the perimeter of planar patch array antenna 150 may be rectangular. Other four-sided polygonal type shapes, similar to the rectangular and square shapes may be possible, as would be known to one skilled in the art. These other four-sided polygonal type shapes may be accurately described as "substantially rectangular" and "substantially square."

Coplanar patch array antenna 150 includes four conductive patch elements 152, 154, 156, and 158 that may be identical in shape. In one embodiment, patches 152, 154, 156, and 158 may be rectangular or substantially rectangular in configuration. In another embodiment, patches 152, 154, 156, and 158 may be square or substantially square in configuration. Patch 152 is electrically connected to patch 154 and patch 156 by interconnecting microstrip elements 151*b* and 151*a*, respectively. Patch 156 is electrically connected to patch 158 by interconnecting microstrip element 151*d*. Patch 154 is electrically connected to patch 158 by interconnecting microstrip element 151*c*. The interconnecting microstrip elements may be of an equal width 150*w*. An additional connective microstrip feed element 159, oriented at a 45 degree angle in the plane of the patch array antenna and the interconnecting microstrip elements, connects patch 152 and opposing patch 158 to feedpoint 140. The interconnecting microstrip elements may be of an equal width 150*w*.

Another subarray of dual-polarization dual-band microstrip patch antenna array structure 100 is coplanar patch array antenna 101. Planar patch array antenna 101 includes four conductive patch elements 102, 104, 106, and 108. Similar to the first subarray, patches 102, 104, 106, and 108 may be rectangular or substantially rectangular in configuration. In another embodiment, patches 102, 104, 106, and 108 may be square or substantially square in configuration. Similar to the configuration of planar patch array antenna 150, the conductive patches of planar patch array antenna 101, patches 102, 104, 106, and 108, are electrically connected to each other by interconnecting microstrip elements 101*e*, 101*f*, 101*g*, and 101*h* that may be of equal width 100*w*. An additional connective microstrip feed element 110, oriented at a 45 degree angle to the plane of the patch array antenna 101 and the interconnecting microstrip elements, connects patch 104 and patch 106 to feedpoint 140.

Planar patch array antenna 150 is positioned within the stacked antenna array 100 structure at an angle that is perpendicular or approximately 90 degrees to planar patch array antenna 101 so that the connective microstrip feed elements 110 and 159 are adjacent and across from each other at feedpoint 140. The crossed connective diagonal microstrip feed elements 110 and 159 function to suppress cross polarization and enhance cross polarization mode isolation.

The interconnecting microstrip elements at the edges of coplanar patch array antenna 150 and coplanar patch array antenna 101 are radiating structures that may radiate horizontal and vertical polarization in-phase based on the dimension of the interconnecting microstrip element. For example, in planar patch array antenna 150 and 101, width 150*w* and 100*w*, respectively, and distance 150*d* and 100*d*, respectively, may be chosen to achieve high gain. For optimal operation, the perimeter of planar patch array antenna 150 and planar patch array antenna 101 is one lambda.

Figure 1B:
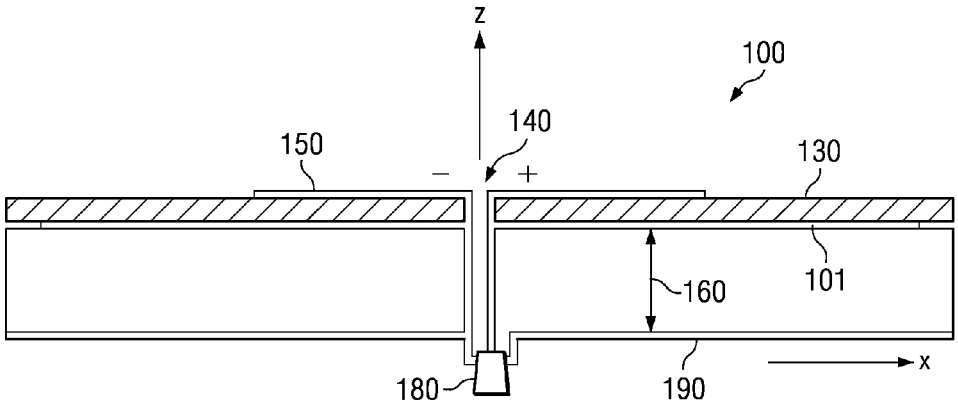
FIG. 1B illustrates a side view of the dual-polarization dual-band microstrip patch antenna array in FIG. 1A in accordance with one embodiment of the present disclosure.

FIG. 1B is a side view of the dual-polarization dual-band microstrip patch antenna array 100 structure illustrated in FIG. 1A. In FIG. 1B, dielectric substrate 130 is disposed parallel to coplanar patch array antenna 150 and coplanar patch array antenna 101. Dielectric substrate 130 may be rectangular or substantially rectangular in configuration and may be located adjacent to coplanar patch array antenna 150. In one embodiment, dielectric substrate 130 is disposed between coplanar patch array antenna 101 and coplanar patch array antenna 150.

Coplanar patch array antenna 150 has a dimension that is different from the dimension of coplanar patch array antenna 101. In one embodiment, the dimensions of the coplanar patch array antenna 150 are sized so that the radiating portions of the patch array antenna 150, elements 151*a*, 151*b*, 151*c*, and 151*d*, do not interfere with the radiating portions, 101*e*, 101*f*, 101*g*, and 101*h* of patch array antenna 101. For example, in coplanar patch array antenna 150, the dimension of the conductive patch elements, 150*a*, the distance between conductive patch elements 150*d*, and the length and width of the interconnecting microstrip elements 150*w*, may be selected to be smaller or shorter than the corresponding dimensions in coplanar patch array antenna 101.

The corresponding dimensions of the coplanar patch array antenna 101 may include, for example, the dimension of the conductive patch elements, 100*a*, the distance between conductive patch elements 100*d*, and the length and width of the interconnecting microstrip elements 100*w*. The coplanar patch array antenna 150 would therefore be of a size to resonate at a wavelength that is shorter than a resonating wavelength of coplanar patch array antenna 101.

A single feedpoint 140 may be disposed through the center of the stacked patch antenna array 100 structure. The center may be located at a midpoint of orthogonal X and Y axes of the stacked antenna array 100. A feedline connected to a coaxial probe 180 may provide a current flow to the stacked patch antenna array 100 structure. The outer shield of coaxial probe 180 may be connected to ground plane 190 and to a first portion of coplanar patch array antennas 150 and 101. The inner conductor of coaxial probe 180 may be connected to a second portion of coplanar patch antenna array structure 150 and 101. The smaller size of coplanar patch antenna array structure 150 with respect to coplanar patch antenna array structure 101 enables a high frequency current to be distributed to coplanar patch array antenna 150 and a low frequency current to be distributed to coplanar patch array antenna 101.

A ground plane 190 may be disposed parallel to the stacked antenna array at a height or distance of 160 from the coplanar patch array antenna 101 opposite coplanar patch array antenna 150.

Figure 1C:
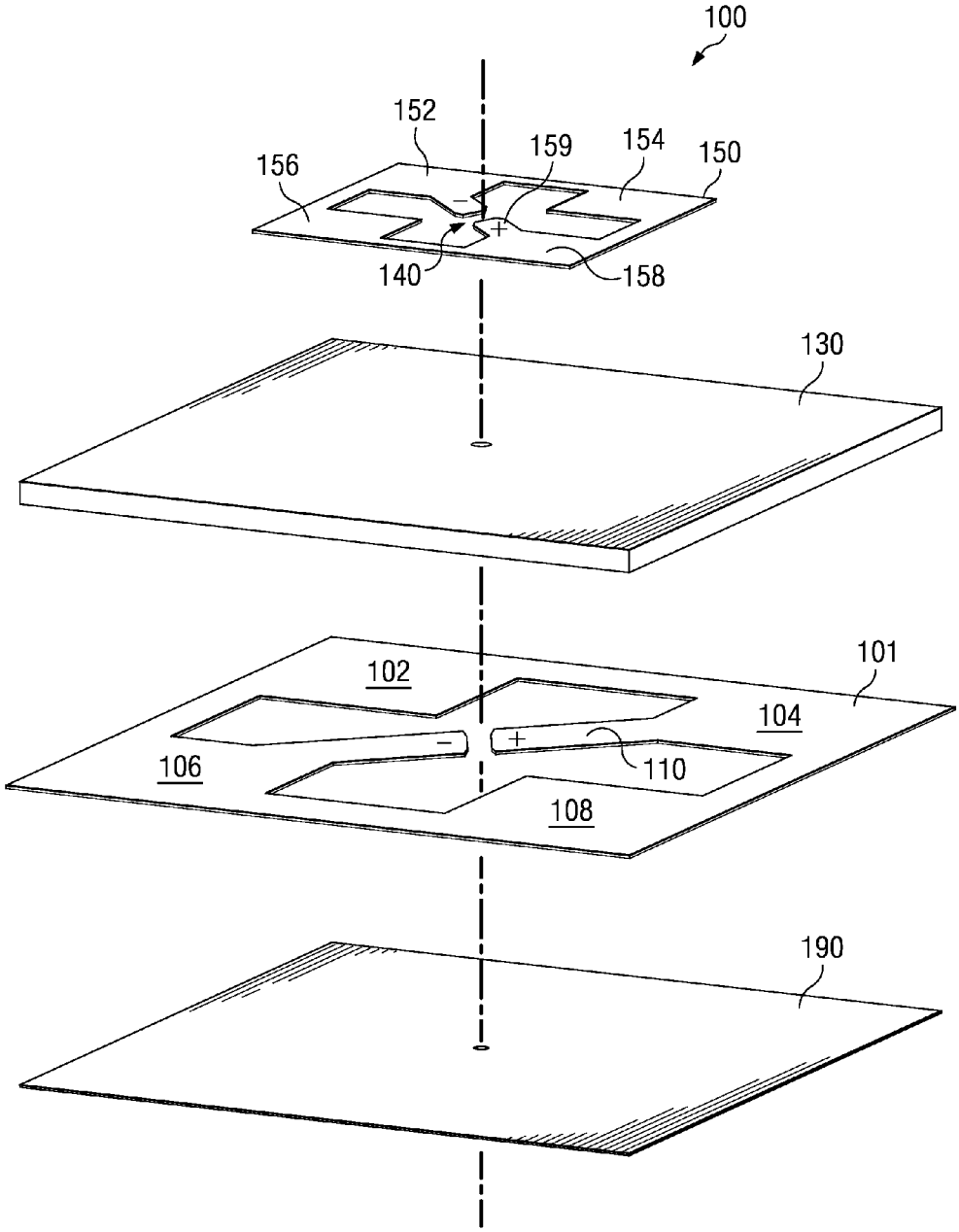
FIG. 1C illustrates an exploded view of the dual-polarization dual-band microstrip patch antenna array in FIG. 1A in accordance with one embodiment of the present disclosure.

Turning now to FIG. 1C, an exploded view of the microstrip stacked patch antenna array 100 structure is illustrated. In FIG. 1C, coplanar patch array antenna 150 is illustrated opposite coplanar patch array antenna 101. In one embodiment, coplanar patch array antenna 150 may be identical in configuration to coplanar patch array antenna 101. It must be noted, however, that in some embodiments, the configuration of coplanar patch array antennas, such as coplanar patch array antennas 150 and 101, may be different. In an embodiment, coplanar patch array antenna 150 may be a different size than coplanar patch array antenna 101. For example, coplanar patch array antenna 150 may be smaller in size than coplanar patch array antenna 101.

A dielectric substrate 130 may be parallel to coplanar patch array antenna 150 and coplanar patch array antenna 101. The dielectric substrate 130 may also be disposed between the coplanar patch array antenna 150 and coplanar patch array antenna 101. The material of the dielectric substrate 130 may be selected to obtain a dielectric constant that will perform according to the conductivity desired. For example, a dielectric constant of one would mean that the dielectric material was air, and effectively non-existent. Other materials would have a dielectric constant greater than one.

Microstrip stacked patch antenna array 100 structure includes a feedpoint 140 extending through a center of the structure that enables feeding from a coaxial probe (not shown), Current is distributed through feedpoint 140 and is distributed through the respective microstrip feed elements 159 and 110 on coplanar patch array antenna 150 and coplanar patch array antenna 101, respectively. The distributed current moves in phase and in a same direction across the interconnecting microstrip elements of coplanar patch array antenna 150 and coplanar patch array antenna 101. Coplanar patch array antenna 150 and coplanar patch array antenna 101 are sized to resonate at different frequencies simultaneously. A ground plane 190 may be directly disposed over coplanar patch antenna array 101.

Figure 2A:
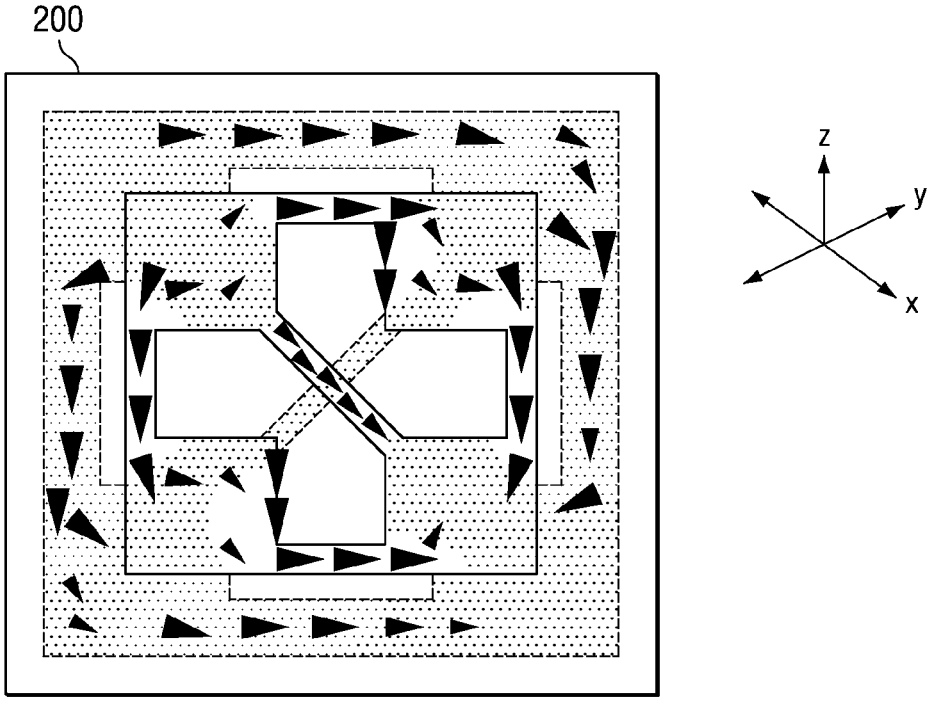
FIG. 2A illustrates a simulated current distribution of the dual-polarization dual-band microstrip patch antenna array in FIG. 1A operating at a high frequency according to one embodiment of the disclosure.

Referring now to FIG. 2A, a simulated current distribution 200 of the microstrip stacked patch antenna array 100 structure is provided. The simulated current distribution 200 shows current being distributed along two orthogonal axes, the X axis and the Y axis, and across the diagonal microstrip feed element in coplanar patch array antenna 150 in a high frequency band of approximately 2.11 gigahertz (GHz).

Figure 2B:
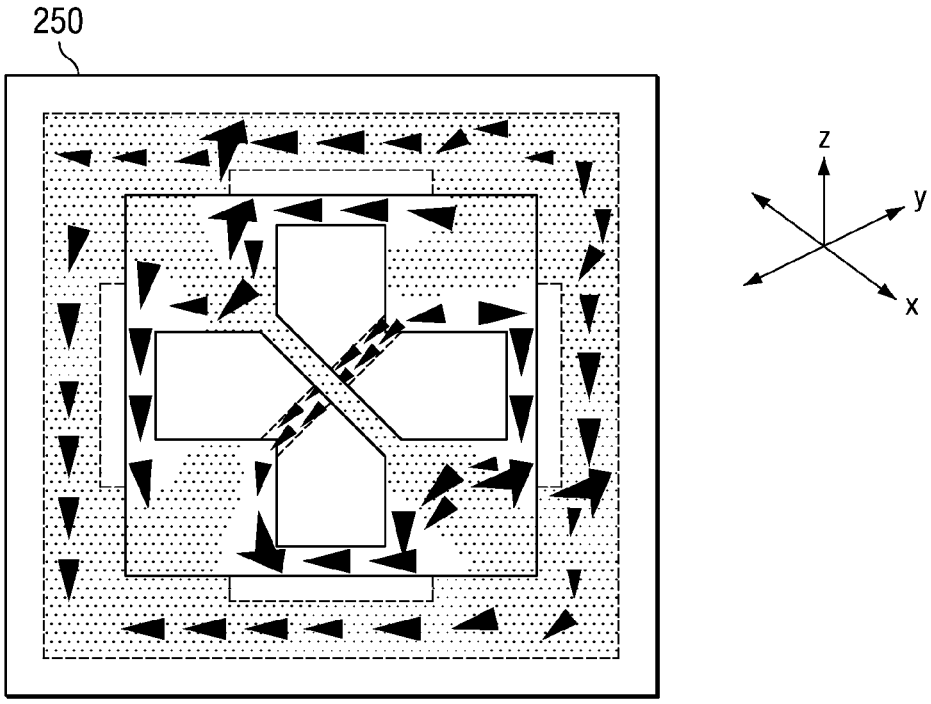
FIG. 2B illustrates a simulated current distribution of the dual-polarization dual-band microstrip patch antenna array in FIG. 1A operating at a low frequency according to one embodiment of the disclosure.

In FIG. 2B, a simulated current distribution 250 of the microstrip stacked patch antenna array 100 structure is provided. The simulated current distribution 250 shows current being distributed in coplanar patch array antenna 101 along two orthogonal axes, the X axis and the Y axis, and across the diagonal microstrip feed element in coplanar patch array antenna 101 in a low frequency band of approximately 1.86 gigahertz (GHz).

Figure 3:
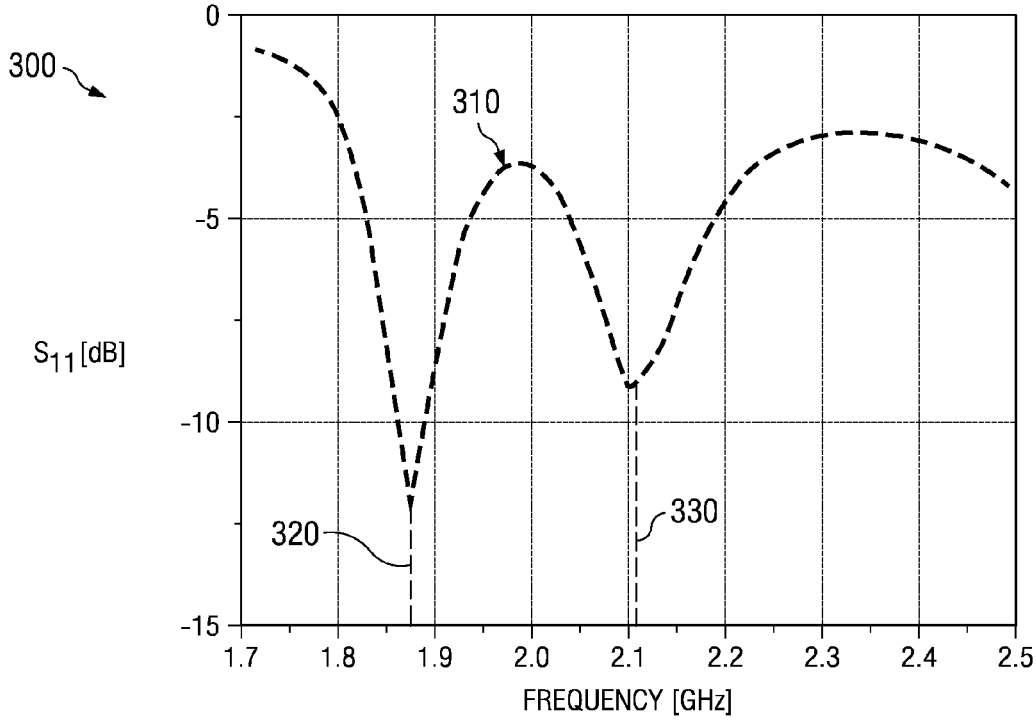
FIG. 3 illustrates a plot of measured return loss at selected operating frequencies for the dual-polarization dual-band microstrip patch antenna array according to one embodiment of the disclosure.

Turning now to FIG. 3, a plot 300 provides curve 310 that represents a measured return loss at the resonant operating frequencies of approximately 1.86 GHz 320 and approximately 2.11 GHz 330 for microstrip stacked patch antenna array 100 structure of FIG. 1A.

Figure 4:
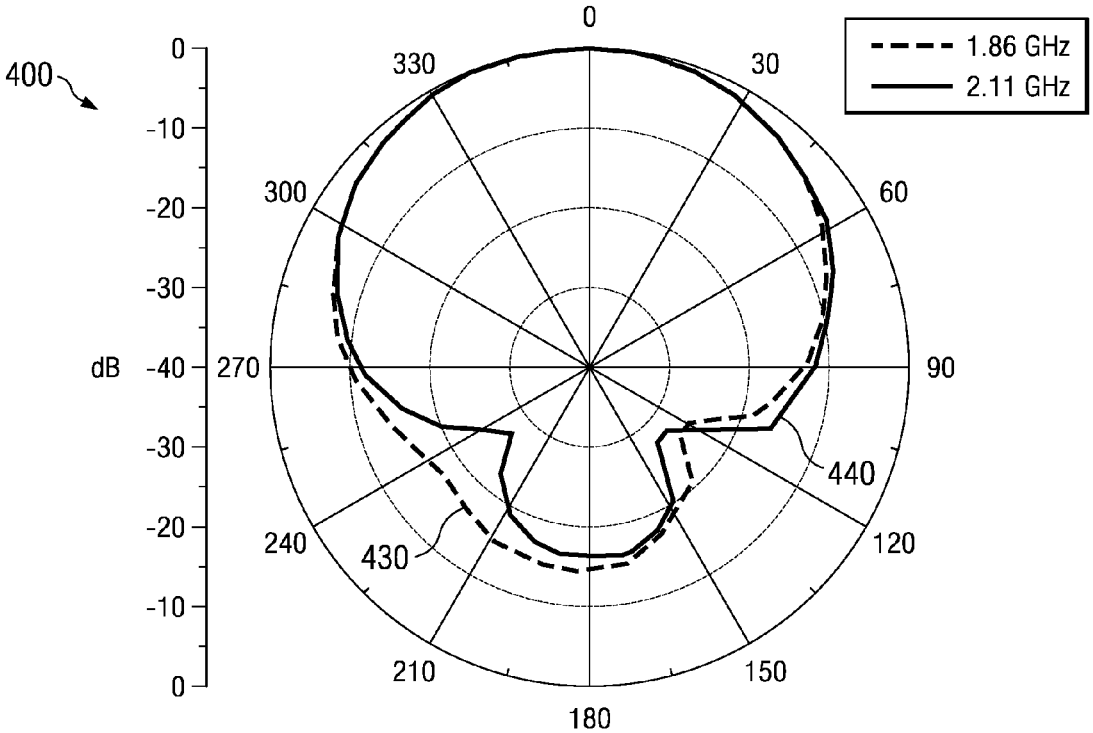
FIG. 4 is a XOZ plot of the radiation pattern of the selected operating frequencies of FIG. 3 according to one embodiment of the disclosure.

Referring now to FIG. 4, two dimensional plot 400 represents the radiation pattern of the microstrip stacked patch antenna array 100 structure of FIG. 1A measured at two different operating frequencies. Radiation pattern 440 represents the radiation pattern at a high frequency of approximately 2.11 GHz. Radiation pattern 430 represents the radiation pattern at a low frequency of approximately 1.86 GHz. It must be noted that the radiation pattern 430 and 440 indicates high directivity.

Figure 5A:
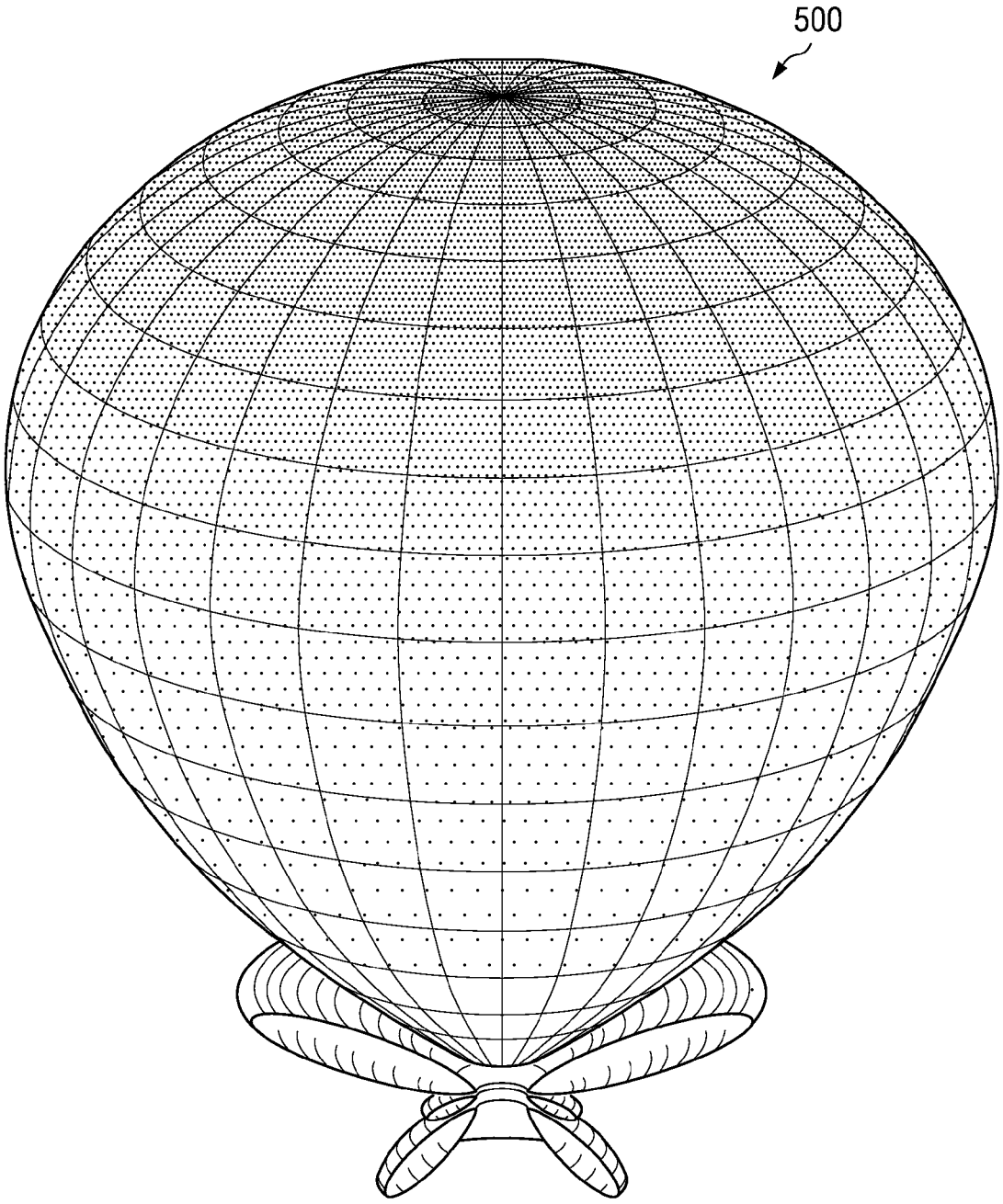
FIG. 5A is a three dimensional view of the measured radiation pattern of the antenna operating at a frequency of 1.91 GHz according to an embodiment of the current disclosure.
Figure 5B:
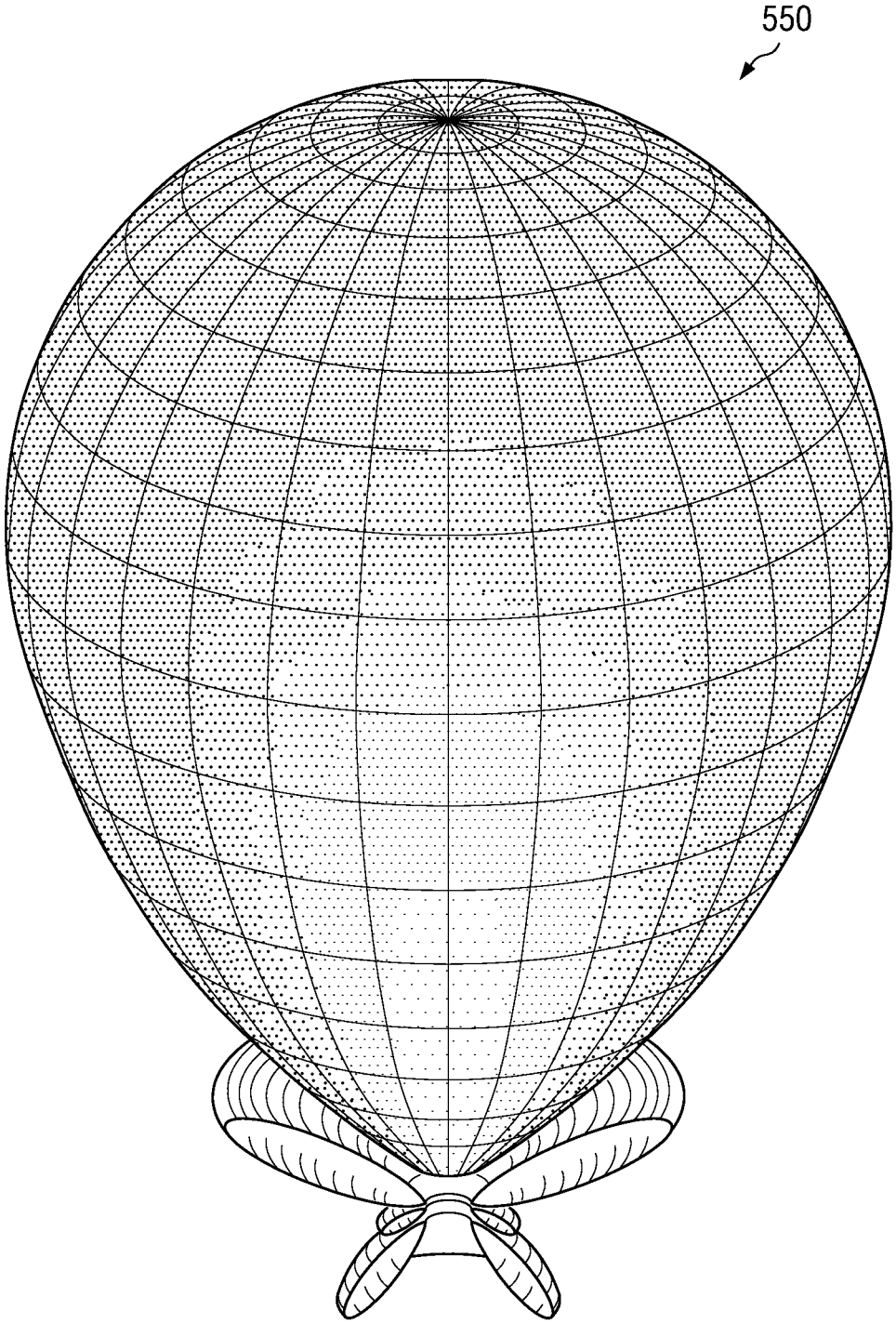
FIG. 5B is a three dimensional view of the measured radiation pattern of the antenna operating at a frequency of 2.04 GHz according to an embodiment of the current disclosure.

FIGS. 5A and 5B represent three dimensional radiation patterns for the microstrip patch antenna array structure 100 of FIG. 1A measured at two different operating frequencies. In FIG. 5A, three dimensional radiation pattern 500 indicates high directivity at a resonant frequency of approximately 1.86 GHz. In FIG. 5B, three dimensional radiation pattern 550 indicates high directivity at a resonant frequency of approximately 2.11 GHz.

Figure 6:
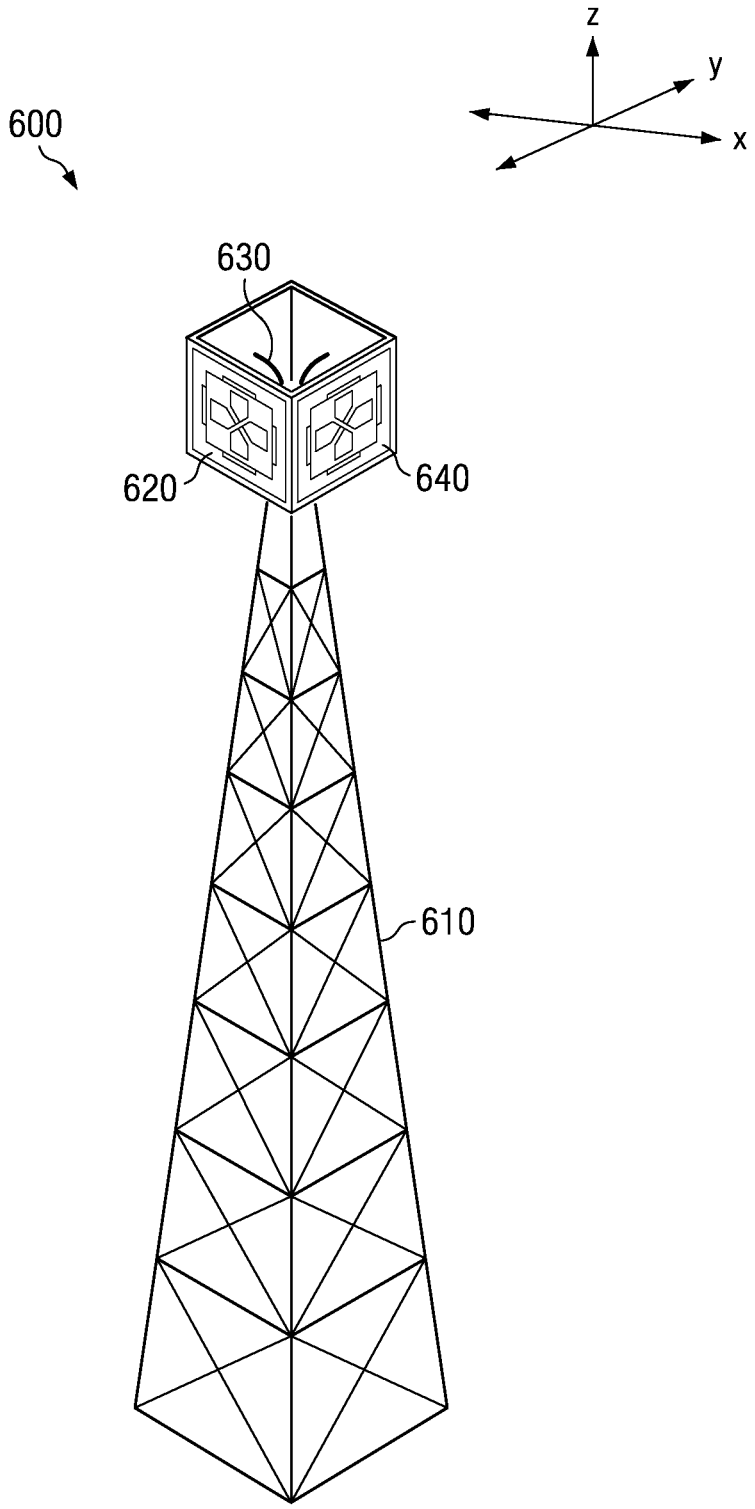
FIG. 6 illustrates a communications system implementing the dual-polarization dual-band microstrip patch antenna array of FIG. 1A according to one embodiment of the disclosure.

Turning now to FIG. 6, communication system 600 illustrates an implementation of microstrip stacked patch antenna array 100 structure of FIG. 1A. In FIG. 6, a plurality of dual polarized, dual frequency patch antenna array structures 620, 630 and 640 may be connected in a contiguous formation to a base transceiver station 610. Each patch antenna array structure may be fed through individual coaxial probes.

Base transceiver station 610 is a fixed transceiver station that may include a base station controller (not shown). Base transceiver station 610 may provide wireless network coverage for a particular coverage area. The base transceiver station 610 transmits communication signals to and receives communication signals from mobile devices within its coverage area. Dual polarized, dual frequency antenna structures 620, 630 and 640 may be affixed on top of base transceiver station 610 and oriented to receive or transmit signals coming from a number of different orthogonal directions.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein.

The embodiment or embodiments selected are chosen and described in order to best explain the principles of the embodiments, the practical application, and to enable others of ordinary skill in the art to understand the disclosure for various embodiments with various modifications as are suited to the particular use contemplated. For example, the various elements or components may be combined or integrated in another system or certain features may be omitted or not implemented.

Also, techniques, systems, and subsystems, described and illustrated in the various embodiments as discrete or separate may be combined or integrated with other systems, modules, or techniques without departing from the scope of the present disclosure. Other items shown or discussed as coupled or directly coupled or communicating with each other may be indirectly coupled or communicated through some other interface, device or intermediate component whether electrically, mechanically, or otherwise. Other examples of changes, substitutions, and alterations are ascertainable by one skilled in the art and could be made without departing from the spirit and scope disclosed herein.

What is claimed is:

1. An antenna comprising:

a first patch antenna array having a number of co-planar conductive patches;

a second patch antenna array having a number of co-planar conductive patches wherein the first patch antenna array and the second patch antenna array are each arranged to provide simultaneous dual polarization radiation patterns, the second patch antenna array sized to resonate at a wavelength that is smaller than a resonating wavelength of the first patch antenna array, the second patch antenna array positioned above and spaced from said first coplanar patch antenna array in a stacked array arrangement and the stacked array arrangement connectable to a single coaxial probe disposed below the first coplanar patch antenna array; and a feedline connected to feedpoints of the first and second patch antenna arrays, the feedline being oriented in a direction that is orthogonal to a plane of the first and second patch antenna arrays, extending from the single coaxial probe to the first patch antenna array and to the second patch antenna array, the feedline providing current flow to the first and second patch antenna arrays from the single coaxial probe, the current flow in the first and second patch antenna arrays providing the dual polarization radiation patterns at dual frequencies each corresponding to resonating wavelengths of the first and second patch antenna arrays respectively.

2. The antenna of claim 1, further comprising a ground plane disposed between the single coaxial probe and the first patch antenna array and parallel to the plane of the stacked patch antenna array at a distance from the first coplanar patch antenna array.

3. The antenna of claim 1, wherein the second patch antenna array is sized such that radiating portions of the first patch antenna array extend beyond a perimeter of the second patch antenna array.

4. The antenna of claim 1, wherein each of the first and second patch antenna arrays has a perimeter that is square.

5. The antenna of claim 4, wherein each of the first and second patch antenna arrays comprises four conductive patch elements disposed in a square arrangement, and wherein each conductive patch element is electrically connected to two adjacent conductive patch elements by a conductive microstrip interconnecting element along the perimeter of the patch antenna array.

6. The antenna of claim 5, wherein the conductive patch elements are square.

7. The antenna of claim 5, wherein each of the first and second patch arrays further comprises a pair of microstrip feed elements that connect a pair of the conductive patch elements, disposed at opposing corners of the respective ones of the first and second patch antenna array, to the feedpoint disposed at approximately a center of the first and second antenna array.

8. The antenna of claim 7, wherein the pair of microstrip feed elements is at an angle of approximately 45 degrees, with respect to an x axis and y axis of the respective ones of the first and second patch antenna array and each microstrip interconnecting element.

9. The antenna of claim 1, further comprising a dielectric substrate that is rectangular in configuration and parallel to the first patch antenna array and the second patch antenna array, and is disposed adjacent to the first patch antenna array.

10. The antenna of claim 9, wherein the dielectric substrate is disposed between the first patch antenna array and the second patch antenna array.

11. The antenna of claim 1, wherein the first patch antenna array and the second patch antenna array are identical in configuration and different in size.

12. The antenna of claim 11, wherein the first patch antenna array is oriented at a rotation angle of 90 degrees with respect to the second patch antenna array.

13. A dual polarized stacked antenna array comprising a plurality of planar patch antenna arrays that are operable simultaneously at respective different resonant frequencies, the dual polarized stacked antenna array comprising:

a first planar patch antenna array that is configured to provide a first simultaneous dual polarization radiation pattern resonate at a first frequency;

a second planar patch antenna array that is configured to provide a second simultaneous dual polarization radiation pattern resonate at a second frequency that is higher than the first frequency; and not more than a single coaxial probe for feeding the stacked antenna array along a feedline that extends through a midpoint of the first planar patch antenna array and a midpoint of the second planar patch antenna array, wherein the feedline is oriented in a direction that is orthogonal to a plane of both the first planar patch antenna array and the second plana patch antenna array, and wherein a direction of feeding is from the first planar patch antenna array to the second planar patch antenna array.

14. The dual polarized stacked antenna array of claim 13, wherein the first planar patch antenna array and the second planar patch antenna array each comprises four conductive patch elements, disposed in a square arrangement, and wherein each conductive patch element is electrically connected to two adjacent conductive patch elements by a conductive microstrip interconnecting element disposed along the perimeter of the respective coplanar patch antenna array.

15. The dual polarized stacked antenna array of claim 14, wherein the first planar patch antenna array and the second planar patch antenna array each further comprises a pair of microstrip feed elements that connect a pair of the conductive patch elements, disposed at opposing corners of each respective planar patch antenna array, to the feedline of the stacked patch antenna array, wherein a first feed element of the pair of microstrip feed elements is attached to an outer sleeve of the coaxial probe and a second feed element of the pair of microstrip feed elements that is attached to a center conductive element of the coaxial probe.

16. The dual polarized stacked antenna array of claim 13, wherein the second planar patch antenna array is sized such that radiating structures of the first planar patch antenna array beyond a perimeter of the second planar patch antenna array.

17. The dual polarized stacked antenna array of claim 15, wherein the pair of microstrip feed elements is inclined at an angle of 45 degrees, with respect to an x axis and y axis of each planar patch antenna array and each microstrip interconnecting element.

18. A communications system comprising: a plurality of center fed stacked planar patch antenna arrays comprising:

a plurality of planar patch antenna arrays that are simultaneously dual-polarized and simultaneously operate at a plurality of different frequencies, wherein each planar patch antenna array is excited through a single feedpoint that extends orthogonally through a midpoint of the stacked planar patch antenna arrays from a feedline of a coaxial probe, wherein a first of the planar patch antenna arrays is sized to resonate at a wavelength that is different from a resonating wavelength of a second of the planar patch antenna arrays; and a base transceiver station comprising an interface that connects to the plurality of planar patch antenna arrays through the coaxial probe.

19. The antenna of claim 1, wherein the second patch antenna array is sized to resonate at a wavelength that is shorter than the resonating wavelength of the first patch antenna array.

20. The antenna of claim 1, wherein an outer shield of the coaxial probe is connected to a first portion of the first and second patch antenna arrays and an inner conductor of the coaxial probe is connected to a second portion of the first and second patch antenna arrays.

21. The antenna of claim 7, wherein the pair of microstrip feed elements of the first patch antenna array extend to a center of first patch antenna array and define a first aperture, the pair of microstrip feed elements of the second patch antenna array extend to a center of second patch antenna array and define a second aperture, and wherein the feedline extends through the first aperture and to the second aperture such that a positive feed connects to a first of the microstrip feed elements of the both the first patch antenna array and the second patch antenna array and a negative feed connects to a second of the microstrip feed elements of the both the first patch antenna array and the second patch antenna array.

22. The antenna of claim 21, further comprising a dielectric substrate disposed between the first patch antenna array and the second patch antenna array and includes an aperture there-through that aligns with the first aperture and the second aperture.

* * * * *